US011690447B2

(12) United States Patent
Luther

(10) Patent No.: US 11,690,447 B2
(45) Date of Patent: Jul. 4, 2023

(54) TRACK SYSTEM FOR USE WITH A STORAGE RACK

(71) Applicant: Compact Engineering LLC, Coopersville, MI (US)

(72) Inventor: Jordan Luther, Coopersville, MI (US)

(73) Assignee: Compact Engineering LLC, Coopersville, MI (US)

( * ) Notice: Subject to any disclaimer, the term of this patent is extended or adjusted under 35 U.S.C. 154(b) by 61 days.

(21) Appl. No.: 17/365,069

(22) Filed: Jul. 1, 2021

(65) Prior Publication Data

US 2023/0000249 A1 Jan. 5, 2023

(51) Int. Cl.

| | |
|---|---|
| ***A47B 53/02*** | (2006.01) |
| ***A47B 47/02*** | (2006.01) |
| ***A47B 45/00*** | (2006.01) |
| *A47B 97/00* | (2006.01) |

(52) U.S. Cl.

CPC ..... *A47B 53/02* (2013.01); *A47B 45/00* (2013.01); *A47B 47/021* (2013.01); *A47B 2097/008* (2013.01)

(58) Field of Classification Search

CPC ..... A47B 53/02; A47B 45/00; A47B 47/021; A47B 2097/008

USPC ..... 312/198–201, 249.8, 249.1; 211/162, 211/1.57, 46; 280/79.3; 296/3

See application file for complete search history.

(56) References Cited

U.S. PATENT DOCUMENTS 2,882,032 A * 4/1959 Garner ..... F27D 3/123 296/3
2,885,090 A * 5/1959 Forman ..... A47F 7/24 211/175
3,920,259 A * 11/1975 Graham ..... B62B 3/008 280/79.3
4,421,365 A * 12/1983 Taniwaki ..... A47B 53/02 295/36.1

(Continued)

FOREIGN PATENT DOCUMENTS

JP 2006250474 * 9/2006
KR 100952204 * 4/2010

(Continued)

OTHER PUBLICATIONS

KR20150043189 English translation (Year: 2015).*
KR101737860 English translation (Year: 2017).*

*Primary Examiner* — Janet M Wilkens
(74) *Attorney, Agent, or Firm* — RMCK Law Group PLC

(57) ABSTRACT

A track system configured for use with a storage rack assembly is provided. The track system comprises first and second forward wheel assemblies, first and second rearward wheel assemblies and a forward axle assembly. The forward axle assembly is coupled between the first and second forward wheel assemblies in an operating position. The forward axle assembly comprises a first intermediate member, a first forward axle member and a second forward axle member. The first forward axle member has a first end coupled to the first forward wheel assembly and a second end slidably coupled to the first intermediate member. The second forward axle member has a first end coupled to the second forward wheel assembly and a second end slidably coupled to the first intermediate member. The first intermediate member inhibits rotation of the first and second forward axle members along their respective axes.

20 Claims, 9 Drawing Sheets

(56) References Cited

U.S. PATENT DOCUMENTS

| | | | | | |
|---|---|---|---|---|---|
| 4,427,379 | A * | 1/1984 | Duran | C21D 9/0025 | 296/3 |
| 4,807,765 | A * | 2/1989 | Brown | A47B 53/00 | 211/162 |
| 5,938,047 | A * | 8/1999 | Ellis | B65G 1/0442 | 414/331.11 |
| 6,726,039 | B2 * | 4/2004 | Boron | A47F 3/06 | 211/187 |
| 7,124,902 | B1 * | 10/2006 | Chen | A47B 53/02 | 211/151 |
| 10,743,680 | B1 * | 8/2020 | Weis | A47F 5/14 | |
| 10,918,208 | B2 * | 2/2021 | Kenlon | A47B 47/024 | |
| 2007/0144992 | A1 * | 6/2007 | Chen | A47F 3/06 | 211/162 |
| 2011/0062100 | A1 * | 3/2011 | Webb | A47B 53/00 | 211/183 |

FOREIGN PATENT DOCUMENTS

| | | | |
|---|---|---|---|
| KR | 101424153 | * | 8/2014 |
| KR | 1020150043189 | * | 4/2015 |
| KR | 101737860 | * | 5/2017 |

* cited by examiner

TRACK SYSTEM FOR USE WITH A STORAGE RACK

FIELD

The present disclosure relates generally to a track system having tracks, wheel assemblies and axle assemblies for use with a storage rack for facilitating movement of the storage rack between storage and access positions.

BACKGROUND

Storage racks are becoming increasingly popular for storing and sorting various items in warehouses and other industrial building complexes. Such storage racks typically have a plurality of shelves horizontally arranged and supported by a frame assembly. In many applications multiple rack units are arranged next to each other. In order to maximize storage space within warehouses these storage racks are commonly arranged very close to each other such that a worker cannot easily walk between adjacent storage racks to observe and/or gain access to the items on the shelves of the storage racks.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A track system configured for use with a storage rack assembly is provided. The storage rack assembly has a frame assembly including first and second forward leg members, first and second rearward leg members and at least one shelf supported generally horizontally by the frame assembly. The track system comprises first and second forward wheel assemblies, first and second rearward wheel assemblies and a forward axle assembly. The first and second forward wheel assemblies are configured to be disposed on the respective first and second forward leg members. The first and second rearward wheel assemblies are configured to be disposed on the respective first and second rearward leg members. The forward axle assembly is coupled between the first and second forward wheel assemblies in an operating position. The forward axle assembly comprises, a first intermediate member, a first forward axle member and a second forward axle member. The first intermediate member extends along a first intermediate axis. The first forward axle member extends along a first forward axle axis. The first forward axle member has a first end coupled to the first forward wheel assembly and a second end slidably coupled to the first intermediate member. The second forward axle member extend along a second forward axle axis. The second forward axle member has a first end coupled to the second forward wheel assembly and a second end slidably coupled to the first intermediate member. In the operating position, the first intermediate member inhibits rotation of the first and second forward axle members along their respective axes and maintains the first and second forward axle members in an orientation whereby the first and second forward axle axes are collinear with the first intermediate axis facilitating parallel rolling of the first and second forward wheel assemblies during movement of the storage rack assembly from a storage position to an access position.

According to additional features, the track system further comprises a rearward axle assembly coupled between the first and second rearward wheel assemblies in an operating position. The rearward axle assembly comprises a second intermediate member, a first rearward axle member and a second rearward axle member. The second intermediate member extends along a second intermediate axis. The first rearward axle member extends along a first rearward axle axis and has a first end coupled to the first rearward wheel assembly and a second end slidably coupled to the second intermediate member. The second rearward axle member extends along a second rearward axle axis and has a first end coupled to the second rearward wheel assembly and a second end slidably coupled to the second intermediate member.

In other features, the first and second forward axle members define first and second respective outer diameters. The first intermediate member defines an inner diameter. The second ends of the respective first and second forward axle members are at least partially received by the first intermediate member such that the first and second outer diameters oppose the inner diameter of the first intermediate member. The first and second rearward axle members define first and second respective outer diameters. The second intermediate member defines an inner diameter. The second ends of the respective first and second rearward axle members are at least partially received by the second intermediate member such that the first and second outer diameters oppose the inner diameter of the second intermediate member. The first forward axle member defines a threaded end that receives complementary threads on a first fastener coupled to the first wheel assembly in the operating position. The second forward axle member defines a threaded end that receives complementary threads on a second fastener coupled to the second wheel assembly in the operating position. The first rearward wheel assembly comprises a first rearward bracket that supports a first rearward wheel for rotation. The second rearward wheel assembly comprises a second rearward bracket that supports a second rearward wheel for rotation.

According to additional features, the track system further comprises a first track and a second track. The first track is configured for placement on a floor. The first track defines a first groove therein. The second track is configured for placement on the floor in an orientation generally parallel to the first track. The second track defines a second groove therein. The first and second rearward wheels are configured to be guided for rolling movement within the respective first and second grooves during movement of the storage rack assembly from the storage position to the access position.

In other features, the track system further comprises a first magnet and a second magnet. The first magnet is disposed on the first track. The first magnet has a forward facing magnetic surface and a rearward facing magnetic surface. The second magnet is disposed on the second track. The second magnet has a forward facing magnetic surface and a rearward facing magnetic surface. The first and second forward wheel assemblies are magnetically coupled to the forward facing magnetic surfaces of the respective first and second magnets in the storage position. The first and second rearward wheel assemblies are magnetically coupled to the rearward facing magnetic surfaces of the respective first and second magnets in the access position.

According to additional features, the first forward wheel assembly comprises a first forward bracket that supports a first forward wheel for rotation. The second forward wheel assembly comprises a second forward bracket that supports a second forward wheel for rotation. The first and second forward wheels can by poly-coated. The first and second forward brackets can each include an upright boss configured to be received by the respective first and second forward and rearward leg members of the frame assembly. The frame assembly can be a wire carriage frame assembly.

In other configurations, the first and second forward and rearward brackets each define a first pair of opposing walls and a second pair of opposing walls that collectively form a rectangular receiving housing. The rectangular receiving housing is configured to receive a leg member of the frame assembly. The frame assembly can be a rivet carriage frame assembly. At least one shim can be configured for placement between a leg member and the rectangular receiving housing.

BRIEF DESCRIPTION OF THE DRAWINGS

The present disclosure will become more fully understood from the detailed description and the accompanying drawings, wherein.

DETAILED DESCRIPTION

Figure 6:
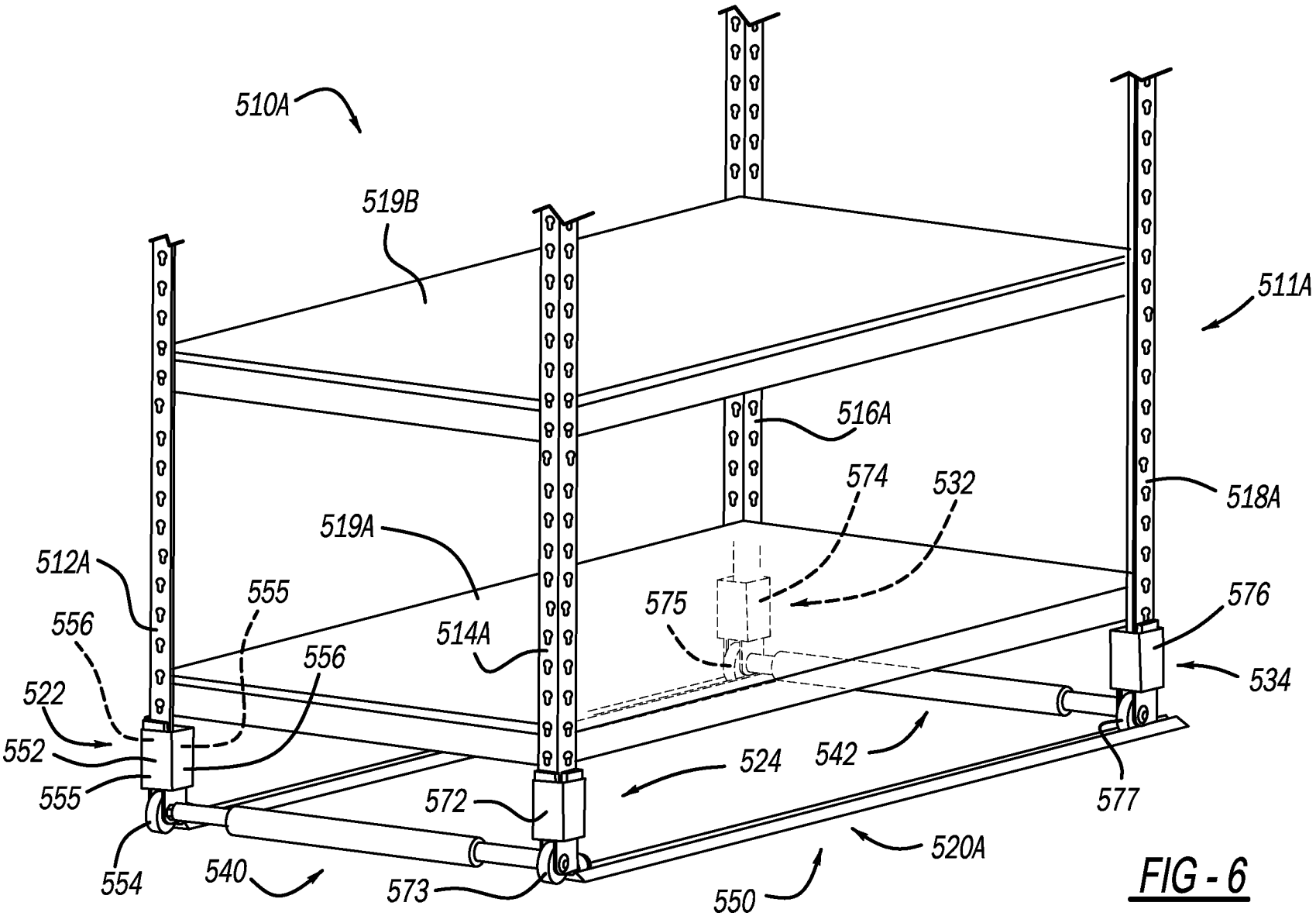
FIG. 6 is a perspective view of a series of rivet carriage storage rack assemblies incorporating forward and rear axle assemblies arranged between corresponding forward and rear wheel assemblies, the rear wheel assemblies configured to ride along respective tracks of a track assembly constructed in accordance to another example of the present disclosure, each rivet carriage storage rack assembly shown in a storage position.
Figure 7:
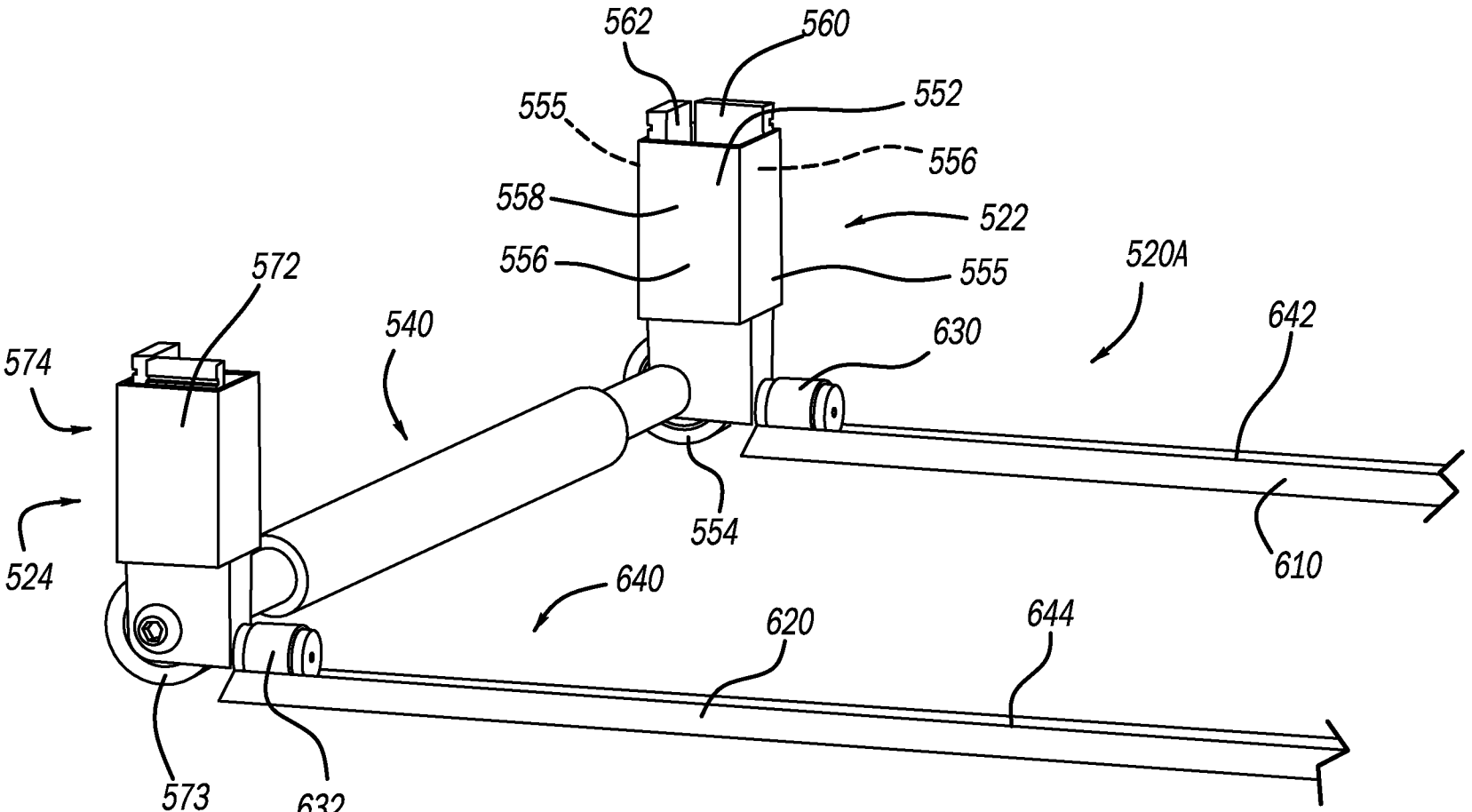
FIG. 7 is a perspective view of the forward wheel assemblies of FIG. 6 magnetically coupled to magnets disposed on the tracks corresponding to the rivet carriage rack assembly in the storage position.
Figure 8:
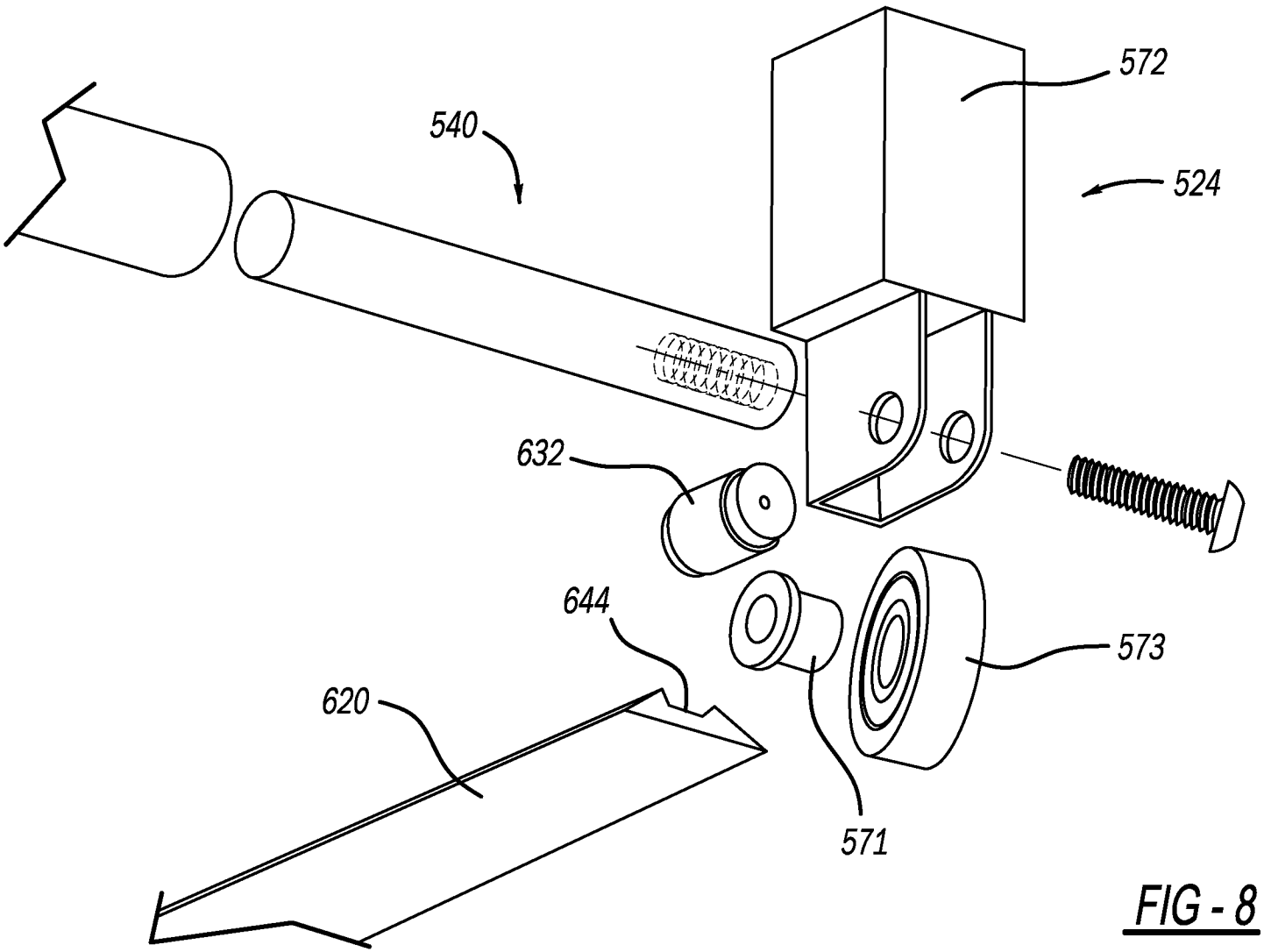
FIG. 8 is an exploded view of a forward wheel assembly of FIG. 7 and shown with a track and portions of a corresponding axle assembly.

As will become appreciated from the following discussion, the present disclosure provides a track system having forward and rearward axle assemblies arranged between corresponding forward and rear wheel assemblies coupled to legs of a storage rack. Tracks are provided for use with the rear wheel assemblies. The axle assemblies, wheel assemblies and tracks are shown cooperating with two storage rack assembly configurations, a wire carriage storage rack assembly (FIG. 1) and a rivet carriage storage rack assembly (FIG. 6). It will be appreciated however that the application of the axle assembles, wheel assemblies and tracks to the wire carriage and rivet carriage storage rack assemblies shown herein is not so limited. In this regard, the track system including axle assemblies, wheel assemblies and/or tracks may be adapted for use with other rack, shelf and/or storage assemblies within the scope of the present disclosure.

Figure 1:
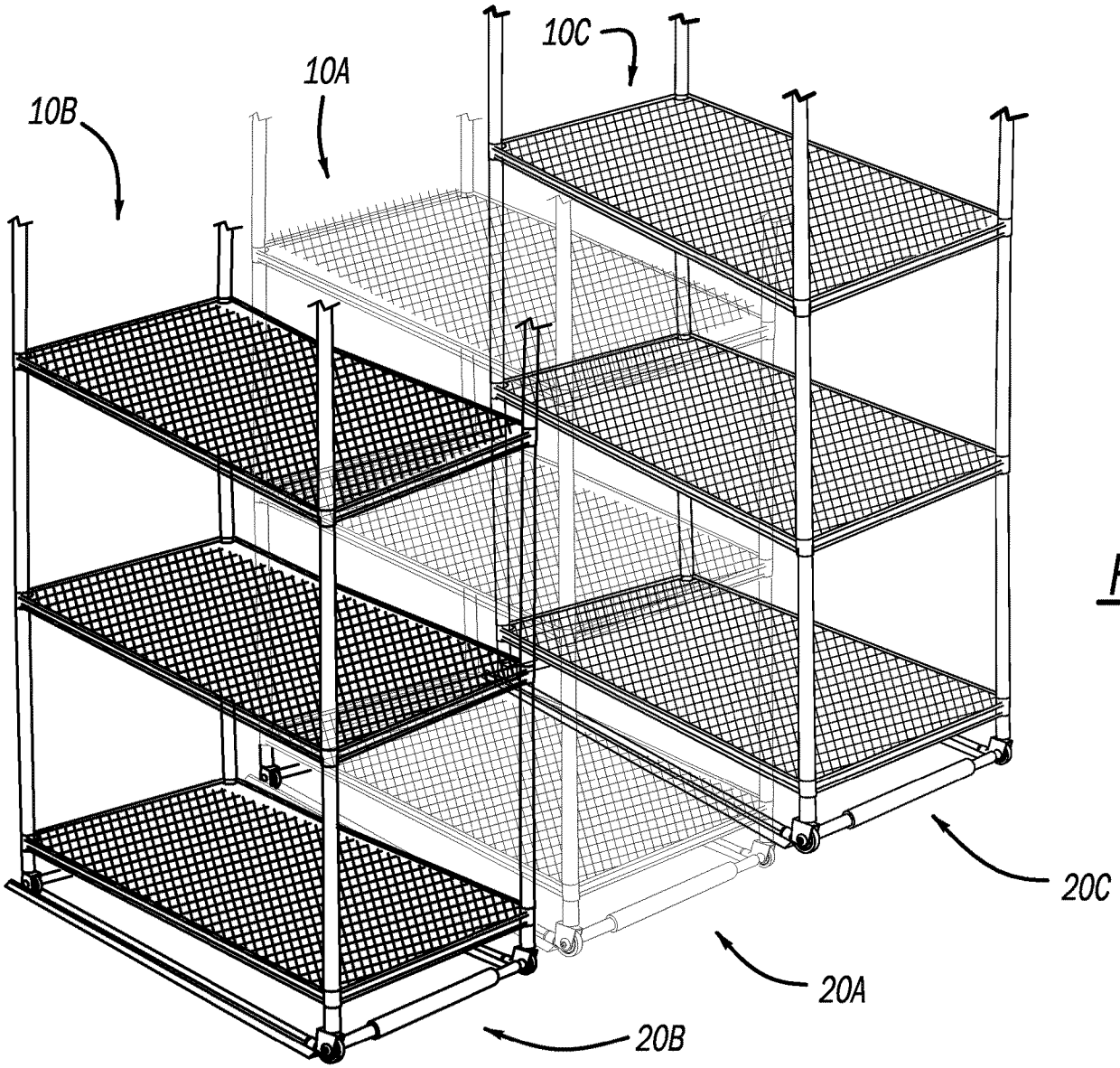
FIG. 1 is a perspective view of a series of wire carriage storage rack assemblies incorporating forward and rear axle assemblies arranged between corresponding forward and rear wheel assemblies, the rear wheel assemblies configured to ride along respective tracks of a track assembly constructed in accordance to one example of the present disclosure, each wire carriage rack assembly shown in a storage position.
Figure 2:
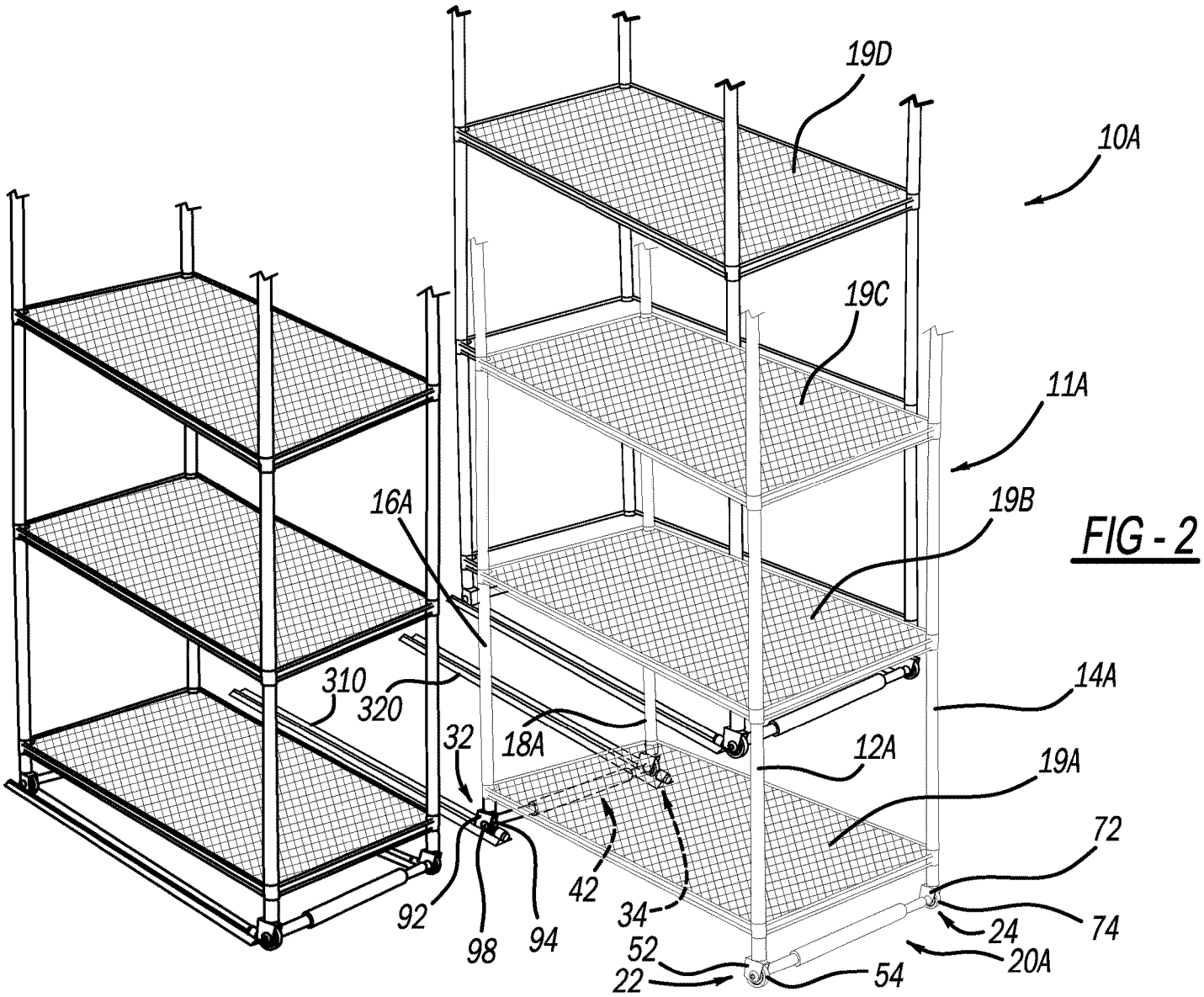
FIG. 2 is a perspective view of the series of wire carriage rack assemblies incorporating the axle assemblies, wheels and tracks of FIG. 1, wherein a second wire carriage storage rack assembly has been moved to an access position.

With initial reference to FIG. 1, a series of storage rack assemblies are shown and generally identified at reference numerals 10A, 10B and 10C. The storage rack assemblies 10A, 10B and 10C can be generally referred to as wire carriage storage rack assemblies. Track systems 20A, 20C and 20B constructed in accordance to one example of the present disclosure are shown generally cooperating with each of the storage rack assemblies 10A, 10C and 10C. As will become appreciated from the following discussion, the track systems 20A, 20B and 20C can used to move any of the storage rack assemblies between storage positions and access positions. The discussion herein will be specifically directed toward movement of the storage rack assembly 10A from the storage position (FIG. 1), to the access position (FIG. 2). In this regard, the discussion herein will be specifically focused only on the track system 20A. However, it will be appreciated that the track systems 20B and 20C are constructed similarly and can be used to move the storage rack assemblies 10B and 10C between storage and access positions. For purposes of discussion, the storage position (FIG. 1) is generally used to refer to the storage rack assembly 10A located laterally adjacent to other storage rack assemblies (such as 10B and 10C, FIG. 1). The access position (FIG. 2) is generally used to refer to the storage rack assembly 10A moved forward whereby a user can gain access to the shelves on the storage rack assembly 10A without being blocked by the other storage rack assemblies 10B and 10C.

The storage rack assembly 10A generally includes a frame assembly 11A having first and second forward legs 12A and 14A and first and second rearward legs 16A and 18A. Shelves 19A, 19B, 19C and 19D are supported generally horizontally by the frame member 11A. While four shelves are shown in FIGS. 1 and 2, it will be appreciated that the storage rack assembly 10A can be configured differently. For example, fewer or more shelves may be provided and/or located at different elevations along the frame assembly 11A.

Figure 3:
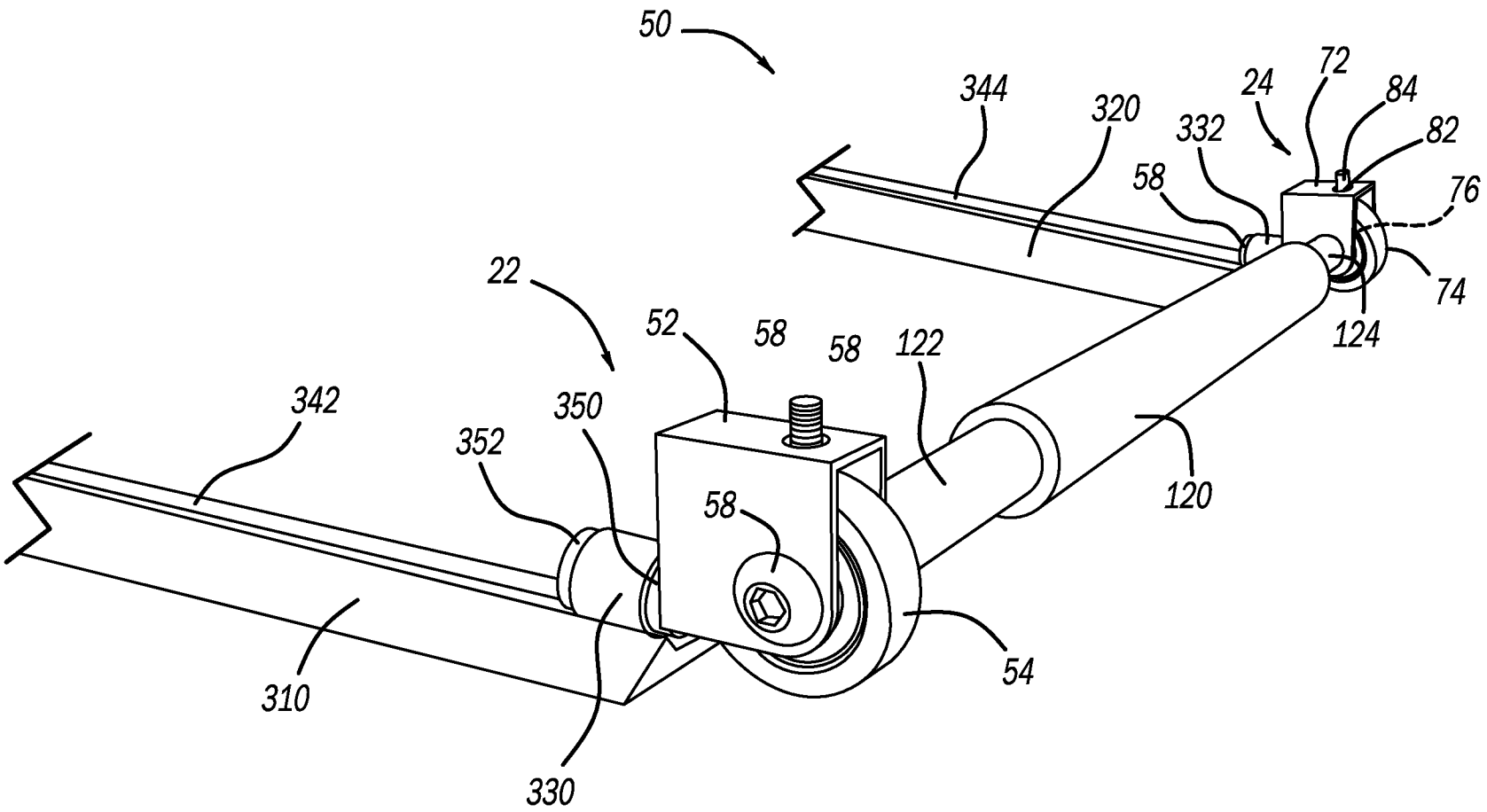
FIG. 3 is a perspective view of the forward wheel assemblies magnetically coupled to magnets disposed on the tracks corresponding to the wire carriage storage rack assembly in the storage position.

With particular reference now to FIGS. 1-3, the track system 20A will be further described. The track system 20A generally includes first and second forward wheel assemblies 22 and 24, first and second rearward wheel assemblies 32 and 34, a forward axle assembly 40, a rearward axle assembly 42 and a track assembly 50. The first forward wheel assembly 22 generally includes a first forward wheel bracket 52 that supports a first forward wheel 54 for rotation around a hub 56 (FIG. 4C) mounted to the first forward wheel bracket 52 by a fastener 58. In one configuration, the first forward wheel bracket 52 can define parallel apertures 60 (FIG. 4C) that receive the fastener 58 in an installed position (FIG. 3). A mounting fastener 62 having a boss 64 can extend upright through an alignment passage 66 defined through the first forward wheel bracket 52. The boss 64 of the mounting fastener 62 can be used to guide and couple the first forward wheel assembly 22 to the first forward leg member 12A. In one configuration the boss 64 can be threaded.

Figure 5A:
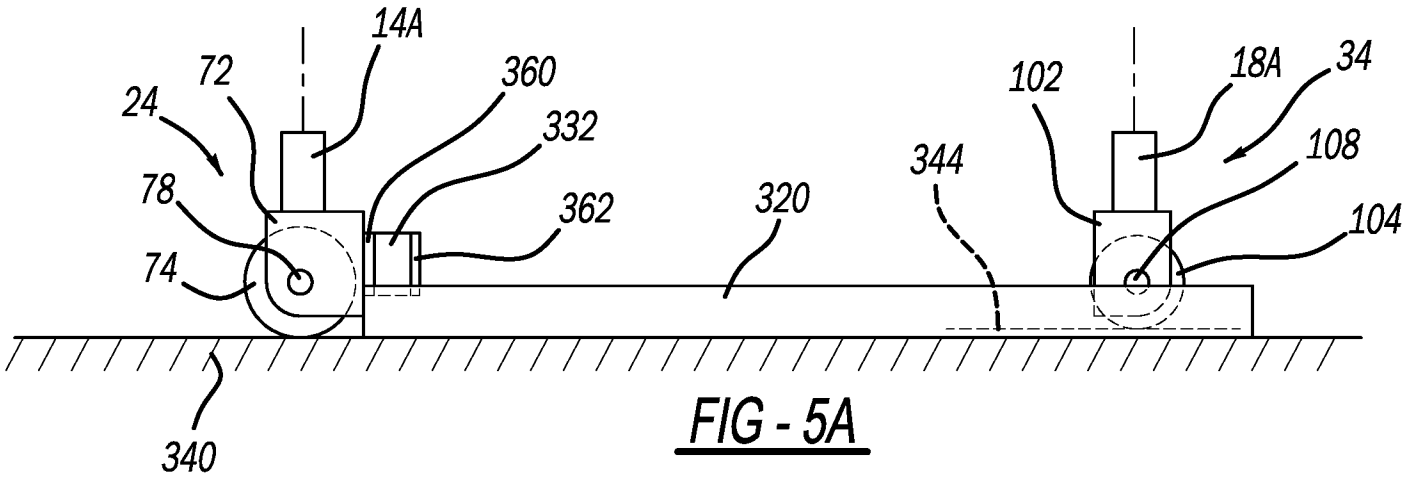
FIG. 5A is a side view of the track assembly of FIG. 1 and shown with forward and rear wheels in a position corresponding to the second wire carriage rack assembly in the storage position.

With particular reference now to FIGS. 3 and 5A, the second forward wheel assembly 24 will be further described. The second forward wheel assembly 24 generally includes a second forward wheel bracket 72 that supports a second forward wheel 74 for rotation around a hub 76 (FIG. 3) mounted to the second forward wheel bracket 74 by a fastener 78 (FIG. 5A). The second forward wheel bracket 72 can be constructed similarly to the first wheel bracket 52 described above. In this regard, a mounting fastener 82 having a boss 84 can be used to guide and couple the second forward wheel assembly 24 to the second forward leg member 14A.

Turning now to FIGS. 2 and 5A, the rearward wheel assemblies 32 and 34 will be described. The first rearward wheel assembly 32 generally includes a first rearward wheel bracket 92 that supports a first rearward wheel 94 for rotation around a hub (such as hub 56, FIG. 4C) mounted to the first rearward wheel bracket 92 by a fastener 98. The second rearward wheel assembly 34 generally includes a second rearward wheel bracket 102 that supports a second rearward wheel 104 for rotation around a hub (such as hub 56, FIG. 4C) mounted to the second rearward wheel bracket 102 by a fastener 108.

Figure 4A:
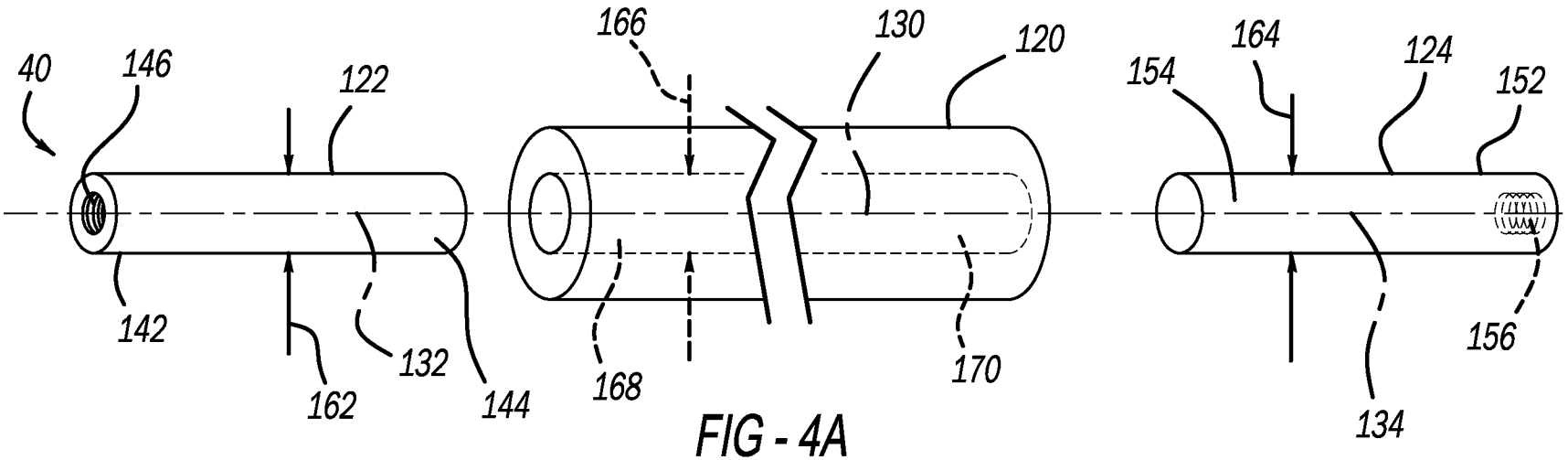
FIG. 4A is an exploded view of a front axle assembly of FIG. 1.

With continued reference to FIGS. 1-3 and additional reference to FIGS. 4A, the forward axle assembly 40 will be further described. The forward axle assembly 40 is configured to be coupled between the first and second forward wheel assemblies 22 and 24 in an operating position (FIG. 3). As used herein, the operating position is used to refer to an axle assembly fully assembled and mounted for use between respective wheel assemblies. The forward axle assembly 40 includes a first intermediate member 120, a first forward axle member 122 and a second forward axle member 124. The first intermediate member 120 extends along a first intermediate axis 130. The first forward axle member 122 extends along a first forward axle axis 132. The second forward axle member 124 extends along a second forward axle axis 134.

The first forward axle member 122 has a first end 142 coupled to the first forward wheel assembly 22 and a second end 144 slidably coupled to the first intermediate member 120. Threads 146 can be defined in the first end 142. The second forward axle member 124 has a first end 152 coupled to the second forward wheel assembly 24 and a second end 154 slidably coupled to the first intermediate member 120. Threads 156 can be defined in the first end 152. As will become appreciated, the second ends 144 and 154 are configured to be received by the first intermediate member 120 in a slip fit relationship.

The first forward axle member 122 defines a first outer diameter 162. The second forward axle member 124 defines a second outer diameter 164. The intermediate member 120 defines an inner diameter 166. The second ends 142 and 152 of the first and second axle members 122 and 124 can be slidably inserted into respective open ends 168 and 170 of the first intermediate member 120. As can be appreciated, the overall length of the axle assembly 40 can be adjusted (based on the depth of insertion of the respective axles 122 and 124 into the first intermediate member) to fit various spans between legs of different storage rack assemblies. In this regard, the axle assemblies and track system as a whole can be easily adapted for use with a wide variety of storage rack combinations having different leg separation dimensions.

Assembly of the axle assembly 40 to the storage rack assembly 10A according to one example of the present disclosure will be described. The second ends 144 and 154 of the respective first and second axles 122 and 124 are inserted into the respective open ends 168 and 170 of the first intermediate member 120 as shown in FIG. 4A. The fastener 58 can then be advanced through the bracket 52 and threadably coupled to the threads 146 in the first axle 122. It will be appreciated that at this point, the first axle 122 is fixed relative to the wheel assembly 22. The first intermediate member 120 and second axle 124 can slide relative to each other in order to span a desired distance between the first and second wheel assemblies 22 and 24. Next, the fastener 78 can be advanced through the bracket 72 and threadably coupled to the threads 156 in the second axle 124. Once both the first and second fasteners 58 and 78 are securely fixed into the axles 122 and 124, the axle assembly is installed. The sequence described above is exemplary. It will be appreciated that the order may be altered.

In the operating position, the first intermediate member 120 inhibits rotation of the first and second forward axle members 122 and 124 along their respective axes 132 and 134 and maintains the first and second forward axle members 122 and 124 in an orientation whereby the first and second forward axle axes 132 and 134 are collinear with the first intermediate axis 130 facilitating parallel rolling of the first and second forward wheel assemblies 22 and 24 during movement of the storage rack assembly 10A from the storage position to the access position.

While the axle assembly 40 (and other axle assemblies herein) has been shown having three components, the first intermediate member 120, the first axle member 122 and the second axle member 124, the axle assembly may be constructed having two pieces or more than three pieces. In this regard, a two piece configuration having the intermediate member 120 that adjustably connects to a first axle member can be provided. The intermediate member 120 (and/or axle assemblies) can be of different shapes such as, but not limited to, angle iron, flat beams, solid beams, hollow beams or other geometries. Whether the axle assembly 40 has two components or more than two, the respective pieces of the axle assembly 40 can adjust relative to each other to create a desired span that can be adopted for receipt between any two axle assemblies on any rack assembly.

Figure 4B:
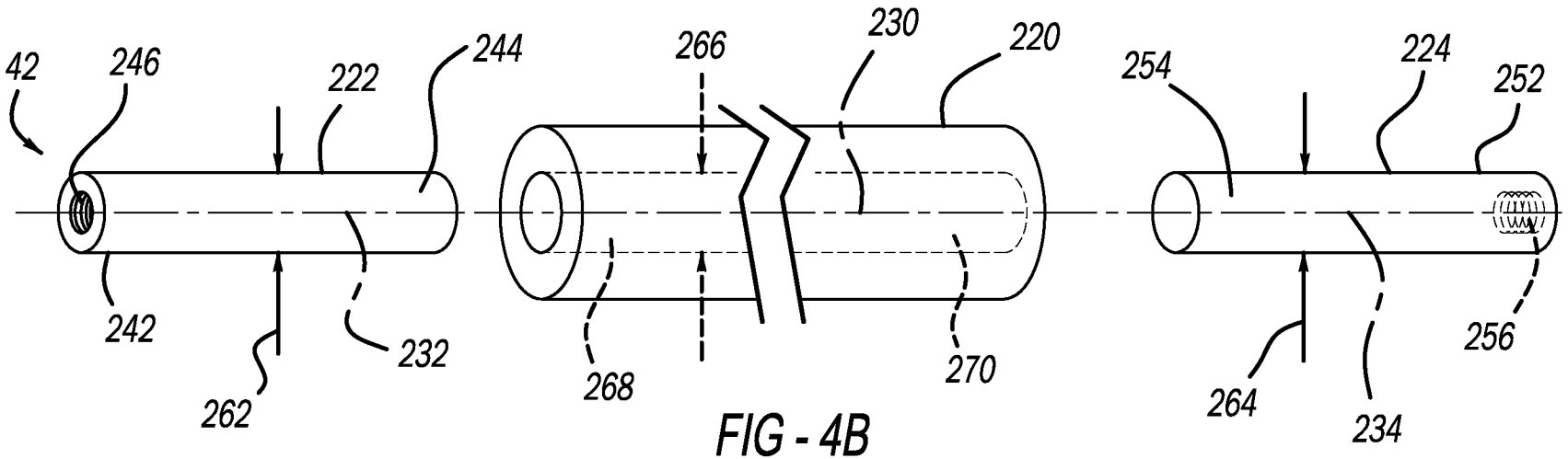
FIG. 4B is an exploded view of a rear axle assembly of FIG. 1.
Figure 4C:
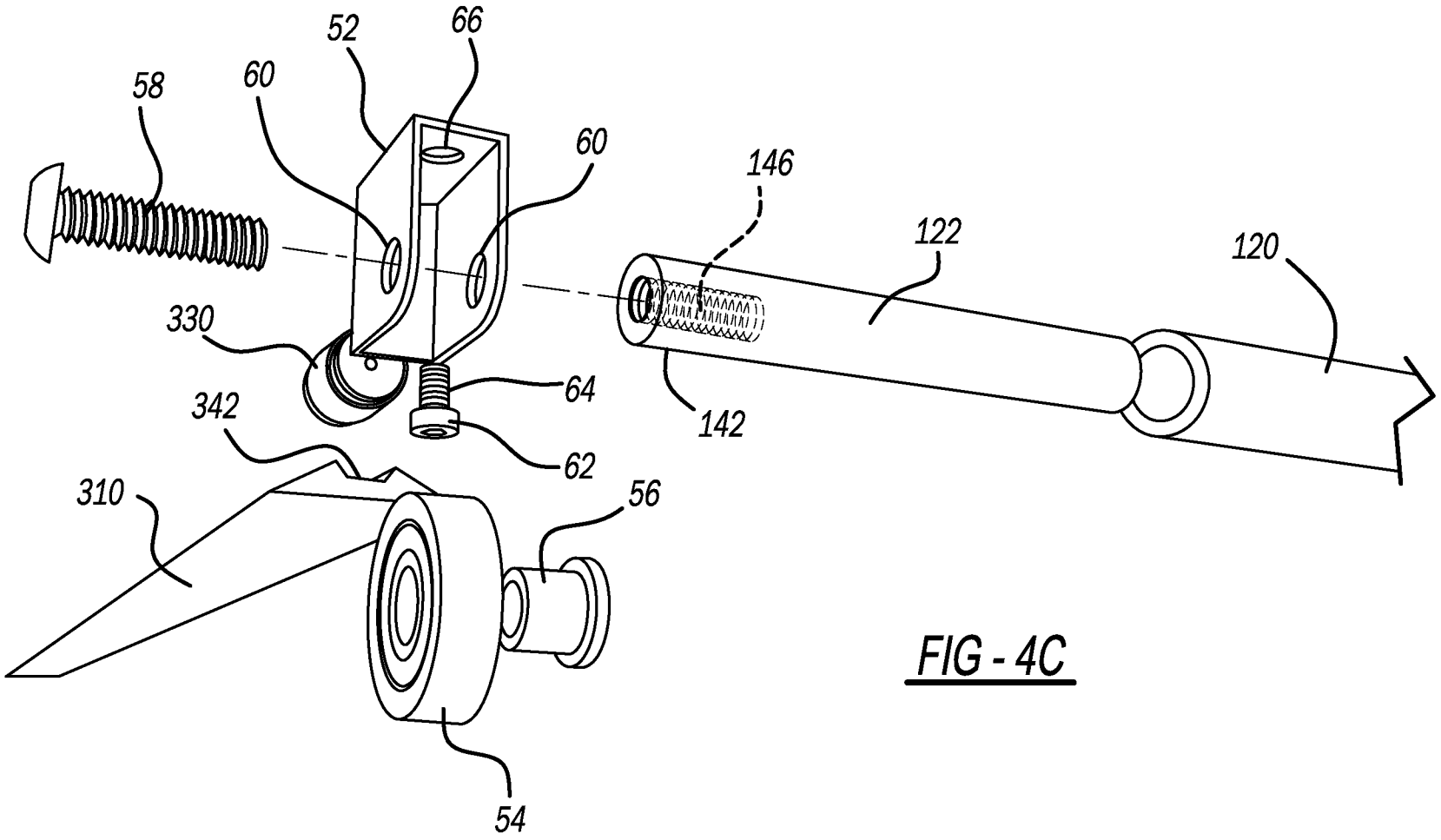
FIG. 4C is an exploded view of a forward wheel assembly and shown with a track and portions of a corresponding axle assembly.

With reference now to FIGS. 2 and 4B, the rearward axle assembly 42 will be further described. The rearward axle assembly 42 is configured to be coupled between the first and second rearward wheel assemblies 32 and 34 in the operating position. The rearward axle assembly 42 generally includes a second intermediate member 220, a first rearward axle member 222 and a second rearward axle member 224. The second intermediate member 220 extends along a second intermediate axis 230. The first rearward axle member 222 extends along a first rearward axle axis 232. The second rearward axle member 224 extends along a second rearward axle axis 234.

The first rearward axle member 222 has a first end 242 coupled to the first rearward wheel assembly 32 and a second end 244 slidably coupled to the second intermediate member 220. Threads 246 can be defined in the first end 242. The second rearward axle member 224 has a first end 252 coupled to the second rearward wheel assembly 34 and a second end 254 slidably coupled to the second intermediate member 220. Threads 256 can be defined in the first end 252. The second ends 244 and 254 are configured to be received by the second intermediate member 220 in a slip fit relationship.

The first rearward axle member 222 defines a first outer diameter 262. The second rearward axle member 224 defines a second outer diameter 264. The second intermediate member 220 defines an inner diameter 266. The second ends 242 and 252 of the first and second axle members 222 and 224 can be slidably inserted into respective open ends 268 and 270 the second intermediate member 220. As with the forward axle assembly 40 described above, the rearward axle assembly 42 can be adjusted to also be accommodated by legs on shelving units that are of different spans. It will be appreciated that while the configuration described herein illustrates the intermediate member receiving the axle members, the axle members may have the larger diameter and configured to receive the intermediate member.

With particular reference now to FIGS. 2, 3, 5A and 5B, the track assembly 50 will be further described. The track assembly 50 generally includes a first track 310, a second track 320, a first magnet 330 and a second magnet 332. The first track 310 is configured for placement on a floor, generally identified at reference 340. The first track 310 defines a groove 342 defined therein. The second track 320 defines a groove 344 therein. The tracks 310 and 320 are configured to be placed onto the floor 340 in a generally parallel orientation. The first and second rearward wheels 94 and 104 are configured to be guided for rolling movement within the respective first and second grooves 342 and 344 during movement of the storage rack assembly 10A from the storage position (FIG. 1), to the access position (FIG. 2).

Figure 5B:
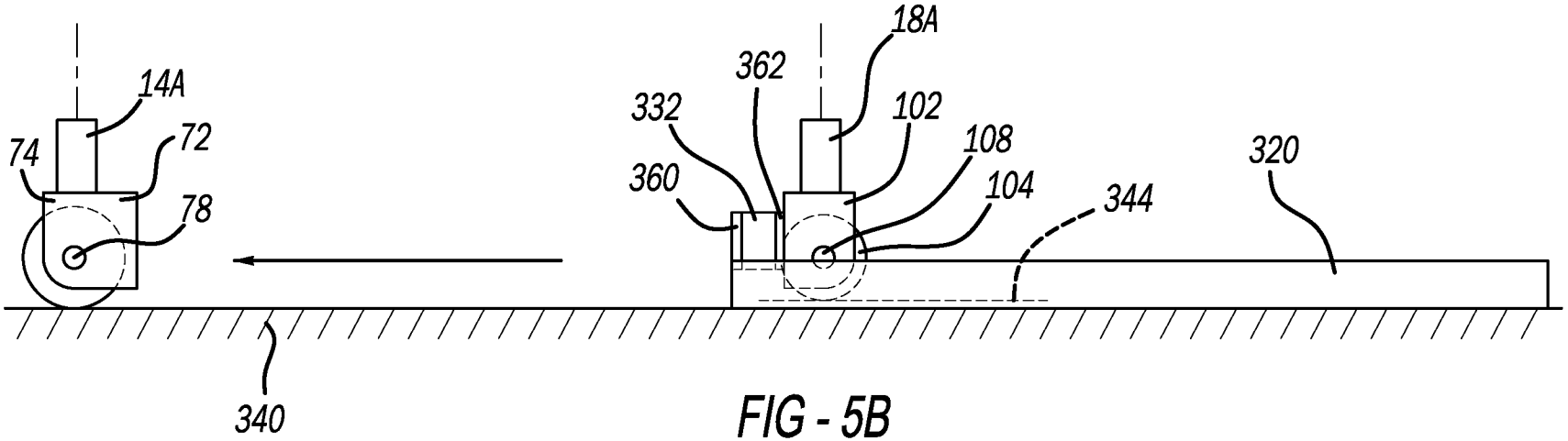
FIG. 5B is the side view of FIG. 5A and shown with the forward and rear wheels in a position corresponding to the second wire carriage storage rack assembly in the access position.

The first magnet 330 includes a forward facing magnetic surface 350 and a rearward facing magnetic surface 352. The second magnet 332 includes a forward facing magnetic surface 360 and a rearward facing magnetic surface 362. The first and second forward wheel assemblies 22 and 24 are magnetically coupled to the forward facing magnetic surfaces 350 and 360 of the first and second magnets 330 and 332 in the storage position (FIG. 5A). The first and second rearward wheel assemblies 32 and 34 are magnetically coupled to the rearward facing magnetic surfaces 352 and 362 of the first and second magnets 330 and 332 in the access position (FIG. 5B). In this regard, the storage rack assembly 10A can attain a positive tactile feedback static position in the storage position when the magnets 330 and 332 magnetically engage the first and second forward wheel assemblies 22 and 24. Similarly, after smooth gliding of the rack assembly 10A from the storage position into the access position, the magnets 330 and 332 magnetically engage the first and second rearward wheel assemblies 32 and 34 providing positive tactile feedback in another static position once the access position is reached.

Turning now to FIGS. 6-9, a rivet carriage storage rack assembly is shown and generally identified at reference numeral 510A. A track system 520A constructed in accordance to another example of the present disclosure is shown generally cooperating with the rivet carriage storage rack assembly 510A. The rivet carriage storage rack assembly 510A includes a frame assembly 511A having first and second forward legs 512A and 514A and first and second rearward legs 516A and 518A. Shelves 519A and 519B are supported generally horizontally by the frame member 511A.

Unless otherwise described herein, the track system 520A can be constructed similarly to the track system 20A described above. In general, the track system 520A includes first and second forward wheel assemblies 522 and 524, first and second rearward wheel assemblies 532 and 534, a forward axle assembly 540, a rearward axle assembly 542 and a track assembly 550. The first forward wheel assembly 522 generally includes a first forward wheel bracket 552 that supports a first forward wheel 554 for rotation. The first forward wheel bracket 552 defines a first pair of opposing walls 555, 556 that collectively form a rectangular receiving housing 558. The rectangular receiving housing 558 is configured to receive the first forward leg 512A. Shims 560, 562 are configured for placement between the leg member 512A and inner walls of the rectangular receiving housing 558. The shims 560 and 562 can define various sizes. It is contemplated that a kit of shims can be provided for selecting a desired thickness shim that locates the leg member 512A into a snug fit within the rectangular receiving housing 558.

The second forward wheel assembly 524 generally includes a second forward wheel bracket 572. The second forward wheel bracket 572 can be constructed similarly to the first forward wheel bracket 552. The second forward wheel bracket 572 supports a second forward wheel 573 on a hub 571. The first rearward wheel assembly 532 generally includes a first rearward bracket 574 that supports a first rearward wheel 575. The second rearward wheel assembly 534 generally includes a second rearward bracket 576 that supports a second rearward wheel 577. The first and second rearward wheel assemblies 532 and 534 can be constructed similarly to the first and second forward wheel assemblies 522 and 524. The rectangular receiving housing 558 described with respect to the first wheel assembly 522 is provided on all of the other wheel assemblies 524, 532 and 534. The rectangular receiving housing 558 provides a solution for adapting the track system 520A to accommodate rivet shelf examples having various leg geometries and configurations. In this way, various legs having various shapes (on a rivet style rack unit shown herein, or any rack unit having any leg shape) can be received by the rectangular receiving housing and shims can be inserted to inhibit lateral movement of the legs when installed into the rectangular receiving housings.

The track assembly 550 can be constructed similarly to the track assembly 50 described above. The track assembly 550 generally includes a first track 610, a second track 620, a first magnet 630 and a second magnet 632. The first track 610 defines a groove 642 defined therein. The second track 320 defines a groove 644 therein. The tracks 610, 612 are configured to be placed onto the floor 640 in a generally parallel orientation. Operation of the track system 520A is similar to the track system 20A described above.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A track system configured for use with a storage rack assembly, the storage rack assembly having a frame assembly including first and second forward leg members, first and second rearward leg members and at least one shelf supported generally horizontally by the frame assembly, the track system comprising:

first and second forward wheel assemblies configured to be disposed on the respective first and second forward leg members;

first and second rearward wheel assemblies configured to be disposed on the respective first and second rearward leg members;

a forward axle assembly coupled between the first and second forward wheel assemblies in an operating position, the forward axle assembly comprising:

a first intermediate member that extends along an intermediate axis;

a first forward axle member that extends along a first forward axle axis, the first forward axle member having a first end coupled to the first forward wheel assembly and a second end slidably coupled to the first intermediate member;

a second forward axle member that extends along a second forward axle axis, the second forward axle member having a first end coupled to the second forward wheel assembly and a second end slidably coupled to the first intermediate member, wherein the first and second axle members are discontinuous and independently slidably coupled to the intermediate member at multiple axial locations providing an adjustable overall length of the forward axle assembly;

wherein in the operating position, the first intermediate member inhibits (i) rotation of the first forward axle member along the first forward axis and (ii) rotation of the second forward axle member along the second forward axis and maintains the first and second axle members in an orientation whereby the first and second axle axes are collinear with the intermediate axis facilitating parallel rolling of the first and second forward wheel assemblies during movement of the storage rack assembly from a storage position to an access position.

2. The track system of claim 1, further comprising:

a rearward axle assembly coupled between the first and second rearward wheel assemblies in an operating position, the rearward axle assembly comprising:

a second intermediate member that extends along a second intermediate axis;

a first rearward axle member that extends along a first rearward axle axis, the first rearward axle member having a first end coupled to the first rearward wheel assembly and a second end slidably coupled to the second intermediate member; and a second rearward axle member that extends along a second rearward axle axis, the second rearward axle member having a first end coupled to the second rearward wheel assembly and a second end slidably coupled to the second intermediate member wherein the first and second rearward axle members are discontinuous and independently slidably coupled to the second intermediate member providing an adjustable overall length of the rearward axle assembly.

3. The track system of claim 2, wherein the first rearward wheel assembly comprises a first rearward bracket that supports a first rearward wheel for rotation and wherein the second rearward wheel assembly comprises a second rearward bracket that supports a second rearward wheel for rotation.

4. The track system of claim 3, further comprising:

a first track configured for placement on a floor, the first track defining a first groove therein; and a second track configured for placement on a floor in an orientation generally parallel to the first track, the second track defining a second groove therein;

wherein the first and second rearward wheels are configured to be guided for rolling movement within the respective first and second grooves during movement of the storage rack assembly from the storage position to the access position.

5. The track system of claim 4, further comprising:

a first magnet disposed on the first track, the first magnet having a forward facing magnetic surface and a rearward facing magnetic surface;

a second magnet disposed on the second track, the second magnet having a forward facing magnetic surface and a rearward facing magnetic surface;

wherein the first and second forward wheel assemblies are magnetically coupled to the forward facing magnetic surfaces of the respective first and second magnets in the storage position and wherein the first and second rearward wheel assemblies are magnetically coupled to the rearward facing magnetic surfaces of the respective first and second magnets in the access position.

6. The track system of claim 5 wherein the first and second forward and rearward brackets each define a first pair of opposing walls and a second pair of opposing walls that collectively form a rectangular receiving housing, the rectangular receiving housing configured to receive a leg member of the frame assembly.

7. The track system of claim 6 wherein the frame assembly is a rivet carriage frame assembly.

8. The track system of claim 7, further comprising at least one shim configured for placement between a leg member and the rectangular receiving housing.

9. The track system of claim 3, wherein the first forward wheel assembly comprises a first forward bracket that supports a first forward wheel for rotation and wherein the second forward wheel assembly comprises a second forward bracket that supports a second forward wheel for rotation.

10. The track system of claim 9 wherein the first and second forward wheels are poly-coated.

11. The track system of claim 9 wherein the first and second forward and rearward brackets each include an upright boss configured to be received by the respective first and second forward and rearward leg members of the frame assembly, wherein the frame assembly is a wire carriage frame assembly.

12. The track system of claim 1, wherein the first and second forward axle members define first and second respective outer diameters and wherein the first intermediate member defines an inner diameter, wherein the second ends of the respective first and second forward axle members are at least partially received by the first intermediate member such that the first and second outer diameters oppose the inner diameter of the first intermediate member.

13. The track system of claim 12, wherein the first and second rearward axle members define first and second respective outer diameters and wherein the second intermediate member defines an inner diameter, wherein the second ends of the respective first and second rearward axle members are at least partially received by the second intermediate member such that the first and second outer diameters oppose the inner diameter of the second intermediate member.

14. The track system of claim 13 wherein the second forward axle member defines a threaded end that receives complementary threads on a second fastener coupled to the second wheel assembly in the operating position.

15. The track system of claim 12 wherein the first forward axle member defines a threaded end that receives complementary threads on a first fastener coupled to the first wheel assembly in the operating position.

16. A track system configured for use with a storage rack assembly, the storage rack assembly having a frame assembly including first and second forward leg members, first and second rearward leg members and at least one shelf supported generally horizontally by the frame assembly, the track system comprising:

first and second forward wheel assemblies configured to be disposed on the respective first and second forward leg members;

first and second rearward wheel assemblies configured to be disposed on the respective first and second rearward leg members;

a forward axle assembly coupled between the first and second forward wheel assemblies in an operating position, the forward axle assembly comprising:

a first intermediate member that extends along an intermediate axis;

a first forward axle member that extends along a first forward axle axis, the first forward axle member having a first end coupled to the first forward wheel assembly and a second end slidably coupled to the first intermediate member;

a second forward axle member that extends along a second forward axle axis, the second forward axle member having a first end coupled to the second forward wheel assembly and a second end slidably coupled to the first intermediate member;

wherein in the operating position, the first intermediate member inhibits (i) rotation of the first forward axle member along the first forward axis and (ii) rotation of the second forward axle member along the second forward axis and maintains the first and second axle members in an orientation whereby the first and second axle axes are collinear with the intermediate axis facilitating parallel rolling of the first and second forward wheel assemblies during movement of the storage rack assembly from a storage position to an access position;

wherein the first and second forward axle members define first and second respective outer diameters and wherein the first intermediate member defines an inner diameter, wherein the second ends of the respective first and second forward axle members are at least partially received by the first intermediate member such that the first and second outer diameters oppose the inner diameter of the first intermediate member, wherein the first forward axle member defines a threaded end that receives complementary threads on a first fastener coupled to the first wheel assembly in the operating position.

17. The track system of claim 16, further comprising:

a rearward axle assembly coupled between the first and second rearward wheel assemblies in an operating position, the rearward axle assembly comprising:

a second intermediate member that extends along a second intermediate axis;

a first rearward axle member that extends along a first rearward axle axis, the first rearward axle member having a first end coupled to the first rearward wheel assembly and a second end slidably coupled to the second intermediate member;

a second rearward axle member that extends along a second rearward axle axis, the second rearward axle member having a first end coupled to the second rearward wheel assembly and a second end slidably coupled to the second intermediate member.

18. The track system of claim 17, wherein the first and second rearward axle members define first and second respective outer diameters and wherein the second intermediate member defines an inner diameter, wherein the second ends of the respective first and second rearward axle members are at least partially received by the second intermediate member such that the first and second outer diameters oppose the inner diameter of the second intermediate member.

19. A track system configured for use with a storage rack assembly, the storage rack assembly having a frame assembly including first and second forward leg members, first and second rearward leg members and at least one shelf supported generally horizontally by the frame assembly, the track system comprising:

first and second forward wheel assemblies configured to be disposed on the respective first and second forward leg members;

first and second rearward wheel assemblies configured to be disposed on the respective first and second rearward leg members;

a forward axle assembly coupled between the first and second forward wheel assemblies in an operating position, the forward axle assembly comprising:

a first intermediate member that extends along an intermediate axis;

a first forward axle member that extends along a first forward axle axis, the first forward axle member having a first end coupled to the first forward wheel assembly and a second end slidably coupled to the first intermediate member, wherein in the operating position, the first intermediate member inhibits rotation of the first forward axle member along the first forward axis and maintains the first axle member in an orientation whereby the first axle axis is collinear with the intermediate axis facilitating parallel rolling of the first and second forward wheel assemblies during movement of the storage rack assembly from a storage position to an access position;

a rearward axle assembly coupled between the first and second rearward wheel assemblies in an operating position, the rearward axle assembly comprising:

a second intermediate member that extends along a second intermediate axis;

a first rearward axle member that extends along a first rearward axle axis, the first rearward axle member having a first end coupled to the first rearward wheel assembly and a second end slidably coupled to the second intermediate member;

a second rearward axle member that extends along a second rearward axle axis, the second rearward axle member having a first end coupled to the second rearward wheel assembly and a second end slidably coupled to the second intermediate member, wherein the first rearward wheel assembly comprises a first rearward bracket that supports a first rearward wheel for rotation and wherein the second rearward wheel assembly comprises a second rearward bracket that supports a second rearward wheel for rotation;

a first track configured for placement on a floor, the first track defining a first groove therein;

a second track configured for placement on a floor in an orientation generally parallel to the first track, the second track defining a second groove therein, wherein the first and second rearward wheels are configured to be guided for rolling movement within the respective first and second grooves during movement of the storage rack assembly from the storage position to the access position a first magnet disposed on the first track, the first magnet having a forward facing magnetic surface and a rearward facing magnetic surface;

a second magnet disposed on the second track, the second magnet having a forward facing magnetic surface and a rearward facing magnetic surface, wherein the first and second forward wheel assemblies are magnetically coupled to the forward facing magnetic surfaces of the respective first and second magnets in the storage position and wherein the first and second rearward wheel assemblies are magnetically coupled to the rearward facing magnetic surfaces of the respective first and second magnets in the access position.

20. The track system of claim 19, wherein the first forward wheel assembly comprises a first forward bracket that supports a first forward wheel for rotation and wherein the second forward wheel assembly comprises a second forward bracket that supports a second forward wheel for rotation.

* * * * *